US010465140B2

(12) United States Patent
Inoue et al.

(10) Patent No.: US 10,465,140 B2
(45) Date of Patent: Nov. 5, 2019

(54) GREASE COMPOSITION

(71) Applicant: NTN CORPORATION, Osaka (JP)

(72) Inventors: Masaharu Inoue, Shizuoka (JP); Kazuhiro Watanabe, Shizuoka (JP); Tomoyoshi Izutsu, Shizuoka (JP); Takayuki Kawamura, Mie (JP); Hiroyuki Amari, Chiba (JP); Minoru Hasegawa, Chiba (JP); Kouhei Nakano, Chiba (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 15/559,413

(22) PCT Filed: Mar. 9, 2016

(86) PCT No.: PCT/JP2016/057298

§ 371 (c)(1),
(2) Date: Sep. 18, 2017

(87) PCT Pub. No.: WO2016/147969

PCT Pub. Date: Sep. 22, 2016

(65) Prior Publication Data

US 2018/0079988 A1 Mar. 22, 2018

(30) Foreign Application Priority Data

Mar. 18, 2015 (JP) ..... 2015-055200

(51) Int. Cl.
*C10M 169/00* (2006.01)
*C10M 111/04* (2006.01)
(Continued)

(52) U.S. Cl.
CPC ..... *C10M 169/00* (2013.01); *C10M 105/36* (2013.01); *C10M 111/04* (2013.01);
(Continued)

(58) Field of Classification Search
CPC ..... C10M 169/00; C10M 105/04; C10M 105/36; C10M 107/02; C10M 111/04;
(Continued)

(56) References Cited

U.S. PATENT DOCUMENTS 8,188,016 B2 * 5/2012 Kohara ..... C10M 139/04 508/154
8,377,858 B2 * 2/2013 Kakizaki ..... C10M 169/00 508/181
(Continued)

FOREIGN PATENT DOCUMENTS

CN 1723270 A 1/2006
JP 03-210394 A 9/1991
(Continued)

OTHER PUBLICATIONS

International Search Report for PCT/JP2016/057298 dated Apr. 5, 2016.
(Continued)

*Primary Examiner* — James C Goloboy
(74) *Attorney, Agent, or Firm* — Hedman & Costigan, P.C.; James V. Costigan; Kathleen A. Costigan

(57) ABSTRACT

It is an object of the present invention to provide a grease composition, for an outer ring rotation type rolling bearing, which is capable of satisfying all of high-temperature durability, low-temperature property, peeling resistance, and rust-preventive property. A grease composition (7) to be enclosed in the outer rig rotation type rolling bearing for use in automotive electric auxiliary machines contains base oil, a thickener, a peeling-resistant additive, a wear-resistant additive, and a rust-preventive agent. The base oil is mixed oil of trimellitic acid ester oil and synthetic hydrocarbon oil mixed therewith in a mass ratio of (70:30) to (90:10). The thickener consists of a diurea compound shown by a formula (1).

$$R^1—NHCONH—R^2—NHCONH—R^1 \quad (1)$$

wherein a reference symbol $R^2$ denotes a divalent aromatic hydrocarbon group having a carbon number of 6 to 15, and a reference symbol $R^1$ denotes a cyclohexyl group.

1 Claim, 1 Drawing Sheet

(51) Int. Cl.

| | |
|---|---|
| ***C10M 169/02*** | (2006.01) |
| ***C10M 105/36*** | (2006.01) |
| ***C10M 115/08*** | (2006.01) |
| ***C10M 125/10*** | (2006.01) |
| ***C10M 169/06*** | (2006.01) |
| ***C10M 137/10*** | (2006.01) |
| ***C10M 105/04*** | (2006.01) |
| ***C10M 107/02*** | (2006.01) |
| ***C10M 129/58*** | (2006.01) |

(52) U.S. Cl.

CPC ..... *C10M 115/08* (2013.01); *C10M 125/10* (2013.01); *C10M 169/02* (2013.01); *C10M 169/06* (2013.01); *C10M 105/04* (2013.01); *C10M 107/02* (2013.01); *C10M 129/58* (2013.01); *C10M 137/10* (2013.01); *C10M 2201/062* (2013.01); *C10M 2205/0285* (2013.01); *C10M 2207/026* (2013.01); *C10M 2207/16* (2013.01); *C10M 2207/28* (2013.01); *C10M 2207/2835* (2013.01); *C10M 2207/2855* (2013.01); *C10M 2215/064* (2013.01); *C10M 2215/1023* (2013.01); *C10M 2215/1026* (2013.01); *C10M 2215/28* (2013.01); *C10M 2219/044* (2013.01); *C10M 2223/045* (2013.01); *C10M 2227/06* (2013.01); *C10N 2210/01* (2013.01); *C10N 2210/06* (2013.01); *C10N 2220/022* (2013.01); *C10N 2220/028* (2013.01); *C10N 2230/00* (2013.01); *C10N 2230/02* (2013.01); *C10N 2230/06* (2013.01); *C10N 2230/08* (2013.01); *C10N 2230/12* (2013.01); *C10N 2240/02* (2013.01); *C10N 2250/10* (2013.01)

(58) Field of Classification Search

CPC ..... C10M 115/08; C10M 125/10; C10M 129/58; C10M 137/10; C10M 169/02; C10M 169/06; C10M 2201/062; C10M 2205/0285; C10M 2207/026; C10M 2207/16; C10M 2207/28; C10M 2207/2835; C10M 2207/2855; C10M 2215/1023; C10M 2215/28; C10M 2219/044; C10M 2223/045; C10M 2227/06; C10N 2250/10; C10N 2210/01; C10N 2201/06; C10N 2220/022; C10N 2220/028; C10N 2230/00; C10N 2230/02; C10N 2230/06; C10N 2230/08; C10N 2230/12; C10N 2240/02

See application file for complete search history.

(56) References Cited

U.S. PATENT DOCUMENTS

| | | | | |
|---|---|---|---|---|
| 2003/0027731 | A1 | 2/2003 | Kawamura | |
| 2006/0073989 | A1* | 4/2006 | Fujita ..... | B82Y 30/00 508/116 |

FOREIGN PATENT DOCUMENTS

| | | | |
|---|---|---|---|
| JP | 2004-332578 | A | 11/2004 |
| JP | 2005-048044 | A | 2/2005 |
| JP | 2005-105238 | A | 4/2005 |
| JP | 2005-298537 | A | 10/2005 |
| JP | 2005-298629 | A | 10/2005 |
| JP | 2009-299897 | A | 12/2009 |
| JP | 4427195 | B2 | 3/2010 |
| JP | 4877343 | B2 | 2/2012 |
| JP | 2013-035882 | A | 2/2013 |
| JP | 2013-253257 | A | 12/2013 |
| JP | 2014-084442 | A | 5/2014 |
| WO | 2004/061058 | A1 | 7/2004 |

OTHER PUBLICATIONS

English Abstract for JP 2013-253257 A dated Dec. 19, 2013.
English Claims for JP 4427195 B2 dated Mar. 3, 2010.
English Abstract for JP 2009-299897 A dated Dec. 24, 2009.
English Claims for JP 4877343 B2 dated Feb. 15, 2012.
English Abstract for JP 2005-298537 A dated Oct. 27, 2005.
English Abstract for JP 2005-105238 A dated Apr. 21, 2005.
English Abstract for CN 1723270 A dated Jan. 18, 2006.
English Abstract for JP 2005-048044 A dated Feb. 24, 2005.
English Abstract for JP 2004-332578 A dated Nov. 25, 2004.
English Abstract for JP 2013-035882 A dated Feb. 21, 2013.
English Abstract for JP 03-210394 A dated Sep. 13, 1991.
Supplementary European Search Report dated Jul. 4, 2018.
English Abstract for JP 2005-298629 A dated Oct. 27, 2005.
English Abstract for JP 2014-084442 dated May 12, 2014.

* cited by examiner

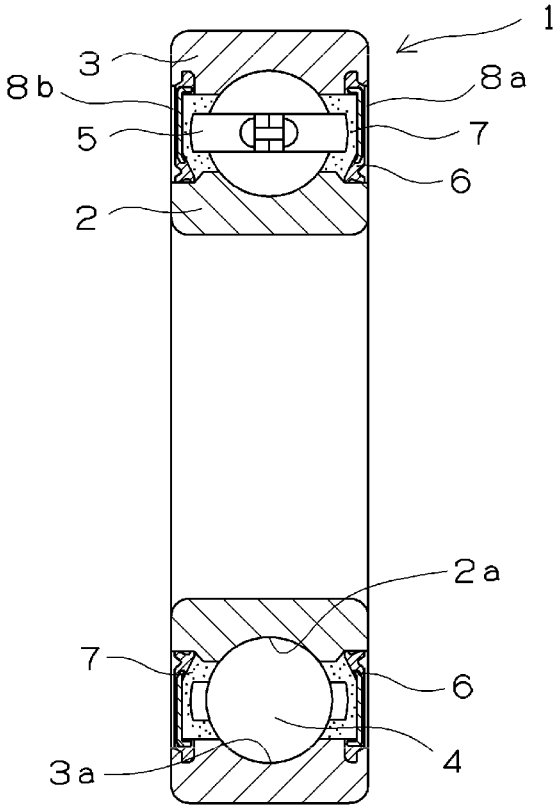
1
3
8b
8a
5
7
6
2
2a
7
6
4
3a

GREASE COMPOSITION

TECHNICAL FIELD

The present invention relates to grease for an outer ring rotation type rolling bearing for use in automotive electric auxiliary machines.

BACKGROUND ART

In recent years, to improve automotive fuel consumption and widen an automotive indoor space, noise reduction, downsizing, and weight saving of automotive parts are advancing. Owing to the production of noise-reduced automotive parts in recent years, an engine room is sealed to a higher extent. Thus, grease for a rolling bearing for use in automotive electric auxiliary machines is demanded to have high-temperature durability. To compensate the downsizing-caused reduction in the outputs of the automotive electric auxiliary machines by rotating the electric auxiliary machines at high speeds, the rolling bearing is used at high speeds and under high loads. Because the use environment for the rolling bearing is becoming increasingly severe, there is a report on the occurrence of a peeling phenomenon accompanied by the structural change of rolling surfaces of the rolling bearing into white, namely, on the occurrence of the hydrogen brittleness-caused peeling phenomenon. Under these circumstances, the grease is demanded to take countermeasures for preventing the occurrence of the hydrogen brittleness-caused peeling phenomenon. In cold districts such as Russia, North America, abnormal noises are generated when an engine is started. The generation of so-called abnormal noises in cold environment has become a problem. Thus, the grease is also demanded to have further improvement in its low-temperature property. In addition, the grease may be subjected to rainwater while automobiles are traveling. Therefore, the grease is also demanded to be rust-preventive. In this situation, the grease is demanded to satisfy all of the high-temperature durability, the peeling resistance, the low-temperature property, and the rust-preventive property.

As grease for the rolling bearing for use in the automotive electric auxiliary machines, grease using base oil such as synthetic hydrocarbon oil, alkyl diphenyl ether oil or ester synthetic oil is most popular. The grease containing the synthetic hydrocarbon oil as its main component is short of its high-temperature durability. The grease containing the alkyl diphenyl ether oil as its main component is short of its low-temperature property. It may be difficult for the grease using the ester synthetic oil as its base oil to achieve its heat resistance and low-temperature property.

As grease having excellent high-temperature durability, diurea grease using the ester synthetic oil is known (patent document 1). As grease having excellent low-temperature property, diurea grease using mixed oil of trimethylolpropane or pentaerythritol ester synthetic oil and the synthetic hydrocarbon oil is known (patent document 2).

As grease having excellent resistance to the occurrence of the hydrogen brittleness-caused peeling (hereinafter referred to as peeling resistance) phenomenon, diurea grease containing molybdates is known (patent document 3).

As grease having excellent rust-preventive property and peeling resistance, diurea grease containing zinc naphthenate and alkenyl succinic acid half ester is known (patent document 4).

Although the grease described in the patent documents 1 through 4 is excellent in anyone or two properties of the high-temperature durability, the low-temperature property, the peeling resistance, and the rust-preventive property, any of the grease is not capable of satisfying all of these properties. As the automotive parts are becoming more silent, smaller, and more lightweight, grease compositions for bearings for use in the automotive parts and particularly grease compositions for the outer ring rotation type rolling bearing are required to satisfy not only one of the above-described properties, but all of the properties.

PRIOR ART DOCUMENTS AND PATENT DOCUMENTS

Patent Documents

Patent document 1: Japanese Patent Application Laid-Open Publication No. 2013-253257

Patent document 2: U.S. Pat. No. 4,427,195

Patent document 3: Japanese Patent Application Laid-Open Publication No. 2009-299897

Patent document 4: U.S. Pat. No. 4,877,343

SUMMARY OF THE INVENTION

Problem to be Solved by the Invention

It is an object of the present invention to provide a grease composition, for an outer ring rotation type rolling bearing, which is capable of satisfying all of high-temperature durability, low-temperature property, peeling resistance, and rust-preventive property.

Means for Solving the Problem

The grease composition of the present invention is enclosed in an outer rig rotation type rolling bearing for use in automotive electric auxiliary machines. The grease composition containing base oil, a thickener, a peeling-resistant additive, a wear-resistant additive, and a rust-preventive agent. The base oil is mixed oil of trimellitic acid ester oil and synthetic hydrocarbon oil mixed therewith in a mass ratio of (70:30) to (90:10).

The thickener consists of a diurea compound shown by a formula (1) shown below.

[chemical formula 1]

$$R^1\text{—NHCONH—}R^2\text{—NHCONH—}R^1 \quad (1)$$

wherein a reference symbol $R^2$ denotes a divalent aromatic hydrocarbon group having a carbon number of 6 to 15, and a reference symbol $R^1$ denotes a cyclohexyl group.

The trimellitic tris ester oil composing the mixed oil has a kinematic viscosity of 40 to 140 $mm^2/s$ at 40 degrees C. and a pour point of not more than −35 degrees C.; and the synthetic hydrocarbon oil has a kinematic viscosity of 10 to 60 $mm^2/s$ at 40 degrees C. and a pour point of not more than −50 degrees C.

The peeling-resistant additive consists of at least one molybdate alkaline metal salt selected from among sodium molybdate, potassium molybdate, and lithium molybdate and contained at 0.1 to 1.5 mass % for a whole amount of the grease composition.

The wear-resistant additive consists of zinc dialkyldithiophosphate and is contained at 0.1 to 2.0 mass % for a whole amount of the grease composition.

The rust-preventive agent contains zinc naphthenate as an essential component thereof and is contained at 0.5 to 5.0 mass % for a whole amount of the grease composition.

Effect of the Invention

The grease composition of the present invention to be enclosed in the outer ring rotation type rolling bearing for use in the automotive electric auxiliary machines satisfies all of the high-temperature durability, the low-temperature property, the peeling resistance, and the rust-preventive property at a high level. Thus, the grease composition restrains the generation of abnormal noises even in a low-temperature environment having a temperature of −40 degrees C., shows excellent durability in a high-temperature environment having a temperature of 180 degrees C., and is capable of restraining the occurrence of the hydrogen brittleness-caused peeling phenomenon even in severe use conditions.

BRIEF DESCRIPTION OF THE DRAWING

FIG. 1 shows a rolling bearing in which a grease composition of the present invention is enclosed.

MODE FOR CARRYING OUT THE INVENTION

As bearings for use in automotive electric auxiliary machines, rolling bearings for use in a fan-coupling apparatus, an alternator, an idler pulley, an electromagnetic clutch for a car air conditioner, an electromotive fan motor, and the like are listed. These rolling bearings include an outer ring rotation type rolling bearing. In addition to requirements such as high-temperature durability, low-temperature property, and peeling resistance demanded for conventional grease compositions to be enclosed in bearings for use in electric auxiliary machines, the grease composition to be enclosed in the outer ring rotation type rolling bearing is demanded to have rust-preventive property.

Essential components composing the grease composition of the present invention are described below.

(1) Base Oil

Base oil is mixed oil of trimellitic acid ester oil and synthetic hydrocarbon oil. The trimellitic acid ester oil has small evaporation loss at high temperatures and excellent oxidative stability. The synthetic hydrocarbon oil has excellent low-temperature property. The mixing ratio between the trimellitic acid ester oil and the synthetic hydrocarbon oil is (70:30) to (90:10) in a mass ratio. That is, the amount of the trimellitic acid ester oil is 70 to 90 mass % for the whole amount of the mixed oil. The remaining part of the mixed oil consists of the synthetic hydrocarbon oil. Thus, the amount of the synthetic hydrocarbon oil is 30 to 10 mass % for the whole amount of the mixed oil. In a case where the ratio between the trimellitic acid ester oil of the base oil and the synthetic hydrocarbon oil thereof is out of this range, the grease composition can satisfy none of the high-temperature durability, the low-temperature property, the peeling resistance, and the rust-preventive property.

The trimellitic acid ester oil is shown by the following formula (2). It is preferable that the trimellitic tris ester oil has a kinematic viscosity of 40 to 140 $mm^2/s$ at 40 degrees C. and a pour point of not more than −35 degrees C.

[Chemical formula 2]

(2)

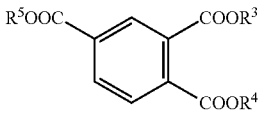

In the formula (2), reference symbols $R^3$, $R^4$, and $R^5$ may be identical to each other or different from each other. It is preferable that the reference symbols $R^3$, $R^4$, and $R^5$ are identical to each other. It is also preferable that the reference symbols $R^3$, $R^4$, and $R^5$ are aliphatic monohydric alcohol residues having a carbon number of 7 to 10. The aliphatic monohydric alcohol residues may be linear alkyl groups or branched alkyl groups. More specifically, as the aliphatic monohydric alcohol residues, tris(2-ethylhexyl) trimellitate, tris(n-octyl) trimellitate, tris(isononyl) trimellitate, and tris (isodecyl) trimellitate are exemplified.

The synthetic hydrocarbon oil is a hydrocarbon compound consisting of carbon and hydrogen. As the hydrocarbon compound, aliphatic hydrocarbon oil such as poly-α-olefin oil, copolymers of the α-olefin oil and olefin, and polybutene; and aromatic hydrocarbon oil such as alkylbenzene, alkyl naphthalene, polyphenyl, and synthetic naphthene are exemplified. Of these hydrocarbon oils, the poly-α-olefin oil is preferable in consideration of its low-temperature property. The poly-α-olefin oil having a kinematic viscosity of 10 to 60 $mm^2/s$ at 40 degrees C. and a pour point of not more than −50 degrees C. is especially preferable. In a case where the poly-α-olefin oil has the kinematic viscosity exceeding 60=$^2$/s, the poly-α-olefin oil has inferior low-temperature property, whereas in a case where the poly-α-olefin oil has the kinematic viscosity less than 10 $mm^2/s$, the poly-α-olefin oil has an inferior heat resistance. In a case where the poly-α-olefin oil has the pour point higher than −50 degrees C., the poly-α-olefin oil has inferior low-temperature property.

(2) Thickener

The thickener consists a diurea compound, shown by the formula (1) previously described, which is excellent in its shear stability and high-temperature durability. A reference symbol $R^2$ denotes a divalent aromatic hydrocarbon group having a carbon number of 6 to 15. In a case where the carbon number of the aromatic hydrocarbon group $R^2$ is less than the smallest numerical value of the above-described range, the grease has an inferior thickening property, whereas in a case where the carbon number of the aromatic hydrocarbon group $R^2$ exceeds the largest numerical value of the above-described range, the grease is liable to harden. Examples of the aromatic hydrocarbon group $R^2$ include an aromatic monocycle, an aromatic condensed ring, and groups consisting of monocycles or condensed rings bonded with methylene chains, cyanuric rings or isocyanuric rings. As preferable aromatic hydrocarbon groups, those shown by the following formula (3) are exemplified.

[Chemical formula 3]

(3)

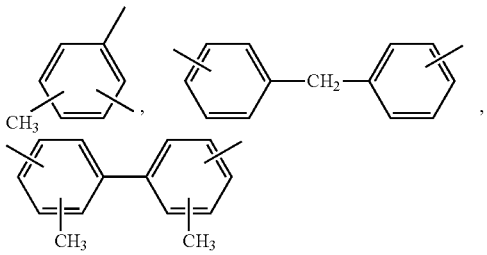

Preferable examples of these groups are shown by the following formula (4).

[Chemical formula 4]

(4)

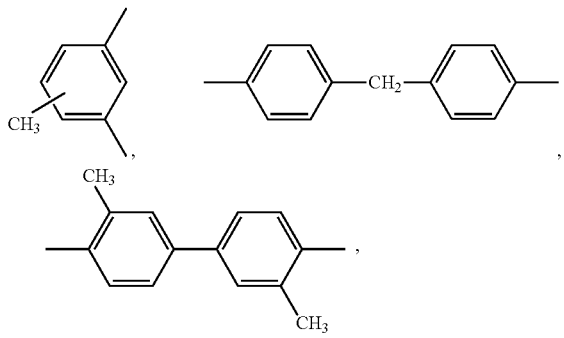

The diurea compound is obtained by reacting a diisocyanate compound and a monoamine compound with each other. The grease can be obtained by reacting the diisocyanate compound and the monoamine compound with each other in the base oil or mix the diurea compound obtained in advance by synthesis with the base oil. The former producing method is preferable because the former producing method keeps the stability of the grease more reliably than the latter producing method.

The mixing amount of the thickener is set to preferably 5 to 25 mass % for the whole amount of the grease. In a case where the mixing amount of the thickener is less than 5 mass %, the grease is soft and thus may leak from the bearing. In a case where the mixing amount of the thickener exceeds 25 mass %, the grease is hard and thus may cause abnormal noises to be generated in cold environment.

(3) Peeling-Resistant Additive

The peeling-resistant additive consists of at least one molybdate alkaline metal salt selected from among sodium molybdate, potassium molybdate, and lithium molybdate. Of these peeling-resistant additives, the potassium molybdate is preferable.

The mixing amount of the peeling-resistant additive is set to favorably 0.1 to 1.5 mass % and more favorably 0.6 to 1.2 mass % for the whole amount of the grease composition. In a case where the mixing amount of the peeling-resistant additive is less than 0.1 mass %, the grease composition is incapable of obtaining a sufficient degree of peeling resistance, whereas in a case where the mixing amount of the peeling-resistant additive exceeds 1.5 mass %, the grease composition may cause abnormal noises to be generated in cold environment.

(4) Wear-Resistant Additive

The wear-resistant additive which improves the high-temperature durability of the grease composition consists of zinc dialkyldithiophosphate (ZnDTP) shown by the following formula (5).

[Chemical formula 5]

(5)

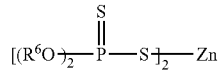

A reference symbol $R^6$ shown in the formula (5) denotes a primary alkyl group or a secondary alkyl group having a carbon atom number of 1 to 24 or an aryl group having a carbon atom number of 6 to 30. Examples of the group $R^6$ include a methyl group, an ethyl group, a propyl group, an isopropyl group, a butyl group, a secondary butyl group, an isobutyl group, a pentyl group, a 4-methylpentyl group, a hexyl group, a 2-ethylhexyl group, a heptyl group, an octyl group, a nonyl group, a decyl group, an isodecyl group, a dodecyl group, a tetradecyl group, a hexadecyl group, an octadecyl group, an eicosyl group, a docosyl group, a tetracosyl group, a cyclopentyl group, a cyclohexyl group, a methyl cyclohexyl group, an ethyl cyclohexyl group, a dimethyl cyclohexyl group, a cycloheptyl group, a phenyl group, a tolyl group, a xylyl group, an ethyl phenyl group, a propyl phenyl group, a butyl phenyl group, a pentyl phenyl group, a hexyl phenyl group, a heptyl phenyl group, an octyl phenyl group, a nonyl phenyl group, a decylphenyl group, a dodecyl phenyl group, a tetradecyl phenyl group, a hexadecyl phenyl group, an octadecyl phenyl group, and a benzyl group. The groups $R^6$ may be identical to each other or different from each other.

Of the above-described groups $R^6$, it is preferable that the group $R^6$ is the primary alkyl group because the primary alkyl group $R^6$ has an excellent stability and contributes to preventing the rolling surfaces of the rolling bearing from being subjected to the hydrogen brittleness-caused peeling phenomenon. In a case where the group $R^6$ is the alkyl group, the larger its carbon atom number is, the higher the wear-resistant additive becomes heat-resistant and more soluble it becomes in the base oil. On the other hand, the smaller its carbon atom number is, the higher the wear-resistant additive becomes wear-resistant and the less soluble it becomes in the base oil. As a commercially available product which can be preferably used in the present invention, a product whose trade name is BECRO-SAN9045 produced by Lubrizol Corporation is exemplified.

The mixing amount of the wear-resistant additive is set to preferably 0.1 to 2.0 mass % for the whole amount of the grease composition. In a case where the mixing amount of the wear-resistant additive is less than 0.1 mass %, the grease composition is incapable of obtaining a sufficient effect. On the other hand, in a case where the mixing amount of the wear-resistant additive exceeds 2.0 mass % for the whole amount of the grease composition, the wear-resistant additive deteriorates the rust-preventive property and high-temperature durability of the grease composition.

(5) Rust-Preventive Agent

The rust-preventive agent contains zinc naphthenate as its essential component. It is favorable that the rust-preventive agent contains not less than 10 mass % of the zinc naphthenate for the whole amount thereof. It is more favorable to use the zinc naphthenate singly as the rust-preventive agent.

The mixing amount of the rust-preventive agent consisting of the zinc naphthenate is set to preferably 0.5 to 5.0 mass % for the whole amount of the grease composition. In a case where the mixing amount of the rust-preventive agent is less than 0.5 mass %, the grease composition has a low rust-preventive property, whereas in a case where the mixing amount of the rust-preventive agent exceeds 5.0 mass %, the rust-preventive agent deteriorates the high-temperature durability of the grease composition.

As rust-preventive agents which can be used in combination with the zinc naphthenate, the following compounds can be exemplified: ammonium salts of organic sulfonic acid; organic sulfonic acid salts and organic carboxylic acid salts of alkaline and alkaline earth metals such as barium, zinc, calcium, and magnesium, and the like; phenate; phosphonate; and derivatives of alkyl and alkenyl succinic acids such as alkyl and alkenyl succinates; partial esters of polyhydric alcohols such as sorbitan monooleate; hydroxy fatty acids such as oleoyl sarcosine; mercapto fatty acids such as 1-mercapto stearic acid or metal salts thereof; higher fatty acids such as stearic acid; higher alcohols such as isostearyl alcohol; esters of the higher alcohols and the higher fatty acids; thiazoles such as 2,5-dimercapto-1,3,4-thiadiazole, 2-mercaptothiadiazole, imidazole compounds such as 2-(decyldithio)-benzoimidazole, and benzimidazole; disulfide compounds such as 2,5-bis(dodecyldithio)benzimidazole; phosphoric acid esters such as tris nonylphenyl phosphite; and thiocarboxylic acid ester compounds such as dilauryl thiopropionate.

It is possible to use other known additives such as an antioxidant, an extreme pressure agent, an oily agent, a viscosity improver, a metal inactivating agent, a surface-active agent, and the like as necessary.

As a mode of the use of the grease composition of the present invention, a rolling bearing in which the grease composition has been enclosed is described below with reference to FIG. 1. FIG. 1 is a sectional view of a grease-enclosed bearing (deep groove ball bearing). In a grease-enclosed bearing 1, an inner ring 2 having an inner ring rolling surface 2*a* on its peripheral surface and an outer ring 3 having an outer ring rolling surface 3*a* on its inner peripheral surface are concentrically disposed, and a plurality of rolling elements 4 is disposed between the inner ring rolling surface 2*a* and the outer ring rolling surface 3*a*. A retainer 5 for retaining a plurality of the rolling elements 4 is provided. A sealing member 6 fixed to the outer ring 3 or the like is provided at openings 8*a* and 8*b* disposed at both axial ends of the inner ring 2 and the outer ring 3. A grease composition 7 of the present invention is applied to at least the peripheries of the rolling elements 4. In the case of the outer ring rotation type rolling bearing, the outer ring 3 rotates with the inner ring 2 being stationary.

EXAMPLES

Examples 1 Through 3 and Comparative Examples 1 Through 7

Base oils of the examples and the comparative examples were prepared at mixing ratios shown in table 1. Each base oil consisted of mixed oil of the tris(isononyl) trimellitate (kinematic viscosity at 40 degrees C.: 90 $mm^2/s$ and pour point: −38 degrees C.) serving as the trimellitic acid ester oil and the poly-α-olefin oil (kinematic viscosity at 40 degrees C.: 30 $mm^2/s$ and pour point: −55 degrees C.) serving as the synthetic hydrocarbon oil. As the polyol ester oil shown in the comparative examples 5 through 7, a commercial product having a trade name of HATCOL H3144 and characteristics that its kinematic viscosity at 40 degrees C.: 71 $mm^2/s$ and its pour point: −48 degrees C. was used. As the zinc dialkyldithiophosphate, a commercial product, having a trade name of BECROSAN9045, which was produced by Lubrizol Corporation was used. As the zinc naphthenate-based rust-preventive agent, a commercial product, having a trade name of Kiresguard C, which was produced by Kiresto Co., Ltd. was used. As the ester-based rust-preventive agent, a commercial product, having a trade name of Nonion OP-80R, which was produced by Nichiyu Co., Ltd. was used. As the sulfonate-based rust-preventive agent, a commercial product, having a trade name of Sulfole Ca-45N, which was produced by MORESCO Corporation was used. As the amine-based antioxidant, a commercial product, having a trade name of VANLUBE81, which was produced by VANDERBILT Corporation was used. As the phenol-based antioxidant, a commercial product, having a trade name of IRGANOX L101, which was produced by BASF corporation was used.

After the above-described mixed base oil was divided into two parts, 4,4'-diphenylmethane diisocyanate was dissolved in one half of the base oil, and cyclohexylamine was dissolved in the other half of the base oil at an equivalent weight twice larger than that of the 4,4'-diphenylmethane diisocyanate in a molar ratio. The 4,4'-diphenylmethane diisocyanate and the cyclohexylamine were dissolved in the mixed base oil in the above-described way so that the mixing ratio of the resulting alicyclic diurea compound of each example and comparative example for the whole amount of the mixed base oil was as shown in table 1. The solution in which the cyclohexylamine was dissolved was added to the solution in which the 4,4'-diphenylmethane diisocyanate was dissolved, while the solution in which the 4,4'-diphenylmethane diisocyanate was dissolved was being stirred. After the operation of stirring the solution in which the 4,4'-diphenylmethane diisocyanate and the cyclohexylamine were dissolved was continued for 30 minutes to react the 4,4'-diphenylmethane diisocyanate and the cyclohexylamine with each other, the resulting alicyclic diurea compound was added to the base oil. After the compounding agents shown in table 1 were added to the base oil at the mixing ratios shown in tale 1, the base oil was stirred at 100 to 120 degrees C. for 10 minutes. Thereafter the base oil was cooled and homogenized by a three-roll mill to obtain a grease composition of each example and comparative example. The properties of each grease composition were evaluated. The test method and the test condition are shown below. Table 1 shows the results.

(1) Worked Penetration

The worked penetration was measured in conformity to JIS K 2220.

(2) High-Temperature Durability (Examined in Conformity to ASTM D 3336)

Grease-enclosed inner ring rotation type rolling bearings were rotated in a high-temperature environment under the following conditions to measure the period of time until before each rolling bearing reached the end of its life.

Bearings: 6204 (iron retainer, metal seal)
Test temperature: 180 degrees C.
Number of rotations of bearings: 10000 rpm
Test load: 67N in both axial and radial loads
Amount of grease enclosed in bearings: 1.8 g (3) Property of Grease in Terms of Prevention of Generation of Abnormal Noise in Cold Environment Grease-enclosed outer ring rotation type rolling bearings were rotated in a low-temperature environment under the following conditions to aurally check each rolling bearing by a tester as to whether the rolling bearing generated abnormal noises in a cold environment. The property of each grease was evaluated based on the pass ratio of the number of test times when abnormal noises were not generated to all the number of test times.

Bearings: 6203
Test temperature: −40 degrees C.
Number of rotations of bearings: 0 to 6670 rpm
Test load: 250N in radial load
Amount of grease enclosed in bearings: 0.56 g (4) Low-Temperature Torque Starting and rotation torques of bearings at −40 degrees C. were measured in conformity to JIS K 2220.

(5) Property of Grease in Terms of Prevention of Occurrence of Hydrogen Brittleness-Caused Peeling Phenomenon Grease-enclosed outer ring rotation type rolling bearings were quickly accelerated and decelerated. The property of each grease was evaluated based on the pass ratio of the number of times when the hydrogen brittleness-caused peeling phenomenon did not occur to all the number of test times.

Bearings: 6203

Test temperature: room temperature

Number of rotations of bearings: 0 to 12000 rpm

Test load: 3000N in radial load

Test period of time: 1000 hours

Amount of grease enclosed in bearings: 0.88 g (6) Rust-Preventive Property of Grease-Applied Bearing Grease-applied tapered roller bearings were immersed in 1 mass % of saltwater for 10 seconds and thereafter allowed to stand in a high-humidity environment. After the test finished, the bearings were taken out from the high-humidity environment to visually observe rolling surfaces of outer rings. As the evaluation method, the rolling surface of each outer ring was divided into 32 sections to calculate the rust generation ratio of each bearing by counting the number of rust-generated sections.

Bearings: 4T-30204

Amount of grease enclosed in bearings: 2.1 g

Test temperature: 40 degrees C.

Test humidity: 100% RH

RH test period of time: 48 hours

The grease composition of the examples 1 through 3 satisfied all of the high-temperature durability, the low-temperature property, the peeling resistance, and the rust-preventive property. On the other hand, because the synthetic hydrocarbon oil was not contained in the grease composition of each of the comparative examples 1 through 4, the grease compositions had inferior low-temperature property. Thus, it may possibly occur that abnormal noises are generated in a cold environment. In the grease composition of the comparative example 1, because the mixing amount of the peeling-resistant additive for the entire grease composition was small, the pass ratio was low in the prevention of the occurrence of the hydrogen brittleness-caused peeling phenomenon. The kind of the rust-preventive agent used in the grease composition of the comparative example 4 was inappropriate. Thus, the rust-preventive agent had an inferior rust-preventive property. Because the grease composition of each of the comparative examples 5 through 7 contained a large amount of the synthetic hydrocarbon oil, the grease composition had inferior high-temperature durability.

INDUSTRIAL APPLICABILITY

Because the grease composition of the present invention satisfies all of the high-temperature durability, the low-temperature property, the peeling resistance, and the rust-preventive property, the grease composition can be preferably utilized for the outer ring rotation type rolling bearing, for use in automotive electric auxiliary machines, which is

TABLE 1

| | | Examples | | | Comparative examples | | | | | | |
|---|---|---|---|---|---|---|---|---|---|---|---|
| | | 1 | 2 | 3 | 1 | 2 | 3 | 4 | 5 | 6 | 7 |
| Base oil (mixing mass ratio) | Trimellitic acid ester | 90 | 85 | 80 | 100 | 100 | 100 | 100 | 55 | — | — |
| | Polyol ester | — | — | — | — | — | — | — | — | 55 | 65 |
| | Synthetic hydrocarbon oil | 10 | 15 | 20 | — | — | — | — | 45 | 45 | 35 |
| Mixing amount of base oil (mass %) | | 62.6 | 62.7 | 62.6 | 63.5 | 62.9 | 83.5 | 82.7 | 77.9 | 77.9 | 76.2 |
| Mixing amount of thickener (mass %) | Alicyclic diurea compound | 12.4 | 12.5 | 12.5 | 12.2 | 12.3 | 11.4 | 12.5 | 17.0 | 17.0 | 18.5 |
| Mixing amount of wear-resistant additive (mass %) | Zinc dialkyldithiophosphate | 0.5 | 0.5 | 0.5 | 0.5 | 0.5 | 0.5 | 0.5 | 0.5 | 0.5 | 1.0 |
| Mixing amount of peeling-resistant additive (mass %) | Potassium molybdate | 1.0 | 1.0 | 1.0 | 0.5 | 1.0 | 1.3 | 1.0 | 1.3 | 1.3 | 1.0 |
| Mixing amount of rust-preventive agent (mass %) | Zinc naphthenate-based | 3.0 | 3.0 | 3.0 | 3.0 | 3.0 | 3.0 | — | 3.0 | 3.0 | — |
| | Ester-based | — | — | — | — | — | — | 1.5 | — | — | 1.5 |
| | Sulfonate-based | — | — | — | — | — | — | 1.5 | — | — | 1.5 |
| Mixing amount of antioxidant (mass %) | Amine-based | 0.2 | 0.2 | 0.2 | 0.2 | 0.2 | 0.2 | 0.2 | 0.2 | 0.2 | 0.2 |
| | Phenol-based | 0.1 | 0.1 | 0.1 | 0.1 | 0.1 | 0.1 | 0.1 | 0.1 | 0.1 | 0.1 |
| Evaluation of properties | Worked penetration (JIS K2220) | 286 | 285 | 286 | 280 | 285 | 274 | 280 | 286 | 294 | 270 |
| | High-temperature durability (hour) | >700 | >700 | >700 | >700 | >700 | >700 | >700 | 677 | 653 | 524 |
| | Pass ratio (%) in prevention of generation of abnormal noise in cold environment | 80 | 80 | 82 | — | 47 | — | — | 0 | 0 | 80 |
| | Low-temperature torque −40 deg. C. (mNm) Starting torque | 30 | 350 | 350 | 510 | 460 | 460 | — | 330 | 990 | 510 |
| | Low-temperature torque −40 deg. C. (mNm) Rotation torque | 150 | 130 | 120 | 220 | 230 | 250 | — | 81 | 150 | 350 |
| | Pass ratio (%) in prevention of occurrence of hydrogen brittleness-caused peeling phenomenon | — | — | 100 | 25 | 75 | — | — | — | — | 42 |
| | Rust generation ratio (%) of grease-applied bearing | 0 | — | 8 | 3 | 0 | 3 | >10 | — | — | 3 |

required to have higher performance than bearings for use in automotive parts other than the automotive electric auxiliary machines.

EXPLANATION OF REFERENCE SYMBOLS AND NUMERALS

1: grease-enclosed bearing
2: inner ring
3: outer ring
4: rolling element
5: retainer
6: sealing member
7: grease composition
8*a*, 8*b*: opening

The invention claimed is:

1. A grease composition to be enclosed in an outer ring rotation type rolling bearing for use in automotive electric auxiliary machines, said grease composition consisting of base oil, a thickener, a peeling-resistant additive, a wear-resistant additive, a rust-preventive agent, and other additives, wherein said base oil is mixed oil of trimellitic acid ester oil and poly-α-olefin oil mixed therewith in a mass ratio of (80:20) to (90:10), said trimellitic acid ester oil has a kinematic viscosity of 40 to 140 $mm^2/s$ at 40 degrees C. and a pour point of not more than −35 degrees C.; and said poly-α-olefin oil has a kinematic viscosity of 10 to 60 $mm^2/s$ at 40 degrees C. and a pour point of not more than −50 degrees C., said thickener consists of a diurea compound shown by a formula (1) shown below

[chemical formula 1]

$$R^1—NHCONH—R^2—NHCONH—R^1 \quad (1)$$

wherein $R^2$ denotes a divalent aromatic hydrocarbon group having a carbon number of 6 to 15, and $R^1$ denotes a cyclohexyl group wherein said thickener is contained in said grease at 5 to 25 mass % for a whole amount of said grease composition, said peeling-resistant additive consists of at least one molybdate alkaline metal salt selected from among sodium molybdate, potassium molybdate, and lithium molybdate and is contained at 0.1 to 1.5 mass % for a whole amount of said grease composition, said wear-resistant additive consists of zinc dialkyldithiophosphate and is contained at 0.1 to 2.0 mass % for a whole amount of said grease composition, said rust-preventive agent is contained at 0.5 to 5.0 mass % for a whole amount of said grease composition, and said other additives are contained at not more than 0.3 mass % for a whole amount of said grease composition.

* * * * *